US005244128A

United States Patent [19]

De Laforcade

[11] Patent Number: 5,244,128

[45] Date of Patent: Sep. 14, 1993

[54] ACTUATOR DEVICE FOR A DISTRIBUTION VALVE

[75] Inventor: Vincent De Laforcade, Clamart, France

[73] Assignee: L'Oreal, Paris, France

[21] Appl. No.: 997,127

[22] Filed: Dec. 23, 1992

Related U.S. Application Data

[63] Continuation of Ser. No. 695,005, May 3, 1991, abandoned.

[30] Foreign Application Priority Data

May 4, 1990 [FR] France ..... 90 05649

[51] Int. Cl.[5] ..... B65D 83/20

[52] U.S. Cl. ..... 222/402.13; 222/402.15

[58] Field of Search ..... 222/402.1, 402.13, 402.15, 222/402.21, 402.23, 402.24

[56] References Cited

U.S. PATENT DOCUMENTS

| | | | |
|---|---|---|---|
| 2,772,819 | 12/1956 | Poarch et al. | 222/402.15 |
| 2,906,440 | 9/1959 | Focht | 222/402.13 |
| 3,270,924 | 9/1966 | Kitabayashi | 222/402.1 |
| 3,325,054 | 6/1967 | Braun | 222/402.13 |
| 3,519,173 | 6/1970 | Sagarin | 222/402.23 |
| 3,865,283 | 2/1975 | Hayes | 222/402.11 |

FOREIGN PATENT DOCUMENTS

| | | | |
|---|---|---|---|
| 2113376 | 6/1972 | France . | |
| 2128223 | 10/1972 | France . | |
| 2164439 | 8/1973 | France . | |
| 1359152 | 7/1974 | United Kingdom | 222/402.15 |
| 2181489 | 4/1987 | United Kingdom | 222/402.13 |

*Primary Examiner*—Andres Kashnikow
*Assistant Examiner*—Kenneth Bomberg
*Attorney, Agent, or Firm*—Cushman, Darby & Cushman

[57] ABSTRACT

This device comprises a push-button (10) acting as a lever on the push-rod (3) of a distribution valve provided on a container (1). This rod (3) defines a longitudinal axis (X—X). The push-button (10) has an outer face (15) comprising a zone for the application of an actuating force and comprises, on the one hand, a projection (20) coming to rest against the end (24) of the rod (3) and, on the other hand, bearing means (32) capable of cooperating with complementary stop means (44) connected to the container. The said zone of application has an angular range of at least approximately 180° and the bearing means (32) and stop means (44) have an angular range corresponding to that of the said zone in order to define together a fulcrum for the said lever, situated in the plane passing through the longitudinal axis (X—X) and the point of application of the actuating force. This device is characterised in that the complementary stop (44) forms part of a collar (11, 111) fixed to the container.

9 Claims, 2 Drawing Sheets

ACTUATOR DEVICE FOR A DISTRIBUTION VALVE

This is a continuation of application Ser. No. 07/695,005, filed on May 3, 1991, which was abandoned upon the filing hereof.

BACKGROUND OF THE INVENTION

This invention relates to an actuator device for a distribution valve provided on a container containing a product to be distributed, especially a pressurised aerosol, the valve comprising a tubular push-rod.

It is well known to use devices of this type, in which an element provided with a projection acts as a lever on the distribution valve comprising a tubular push-rod.

FR-A-2 113 376 describes an actuator device for controlling the delivery of a material from a pressurised container provided with an upper opening formed by a valve seat, the seat being fixed to the opening of the container by a mounting flange or a rolled seal. This device comprises a lever formed in one piece provided at one end with a surface that can be engaged by one finger of the operator and at the other end with a flexible clip which clips on to the flange. Between these two ends the lever comprises a projection coming to rest against the end of the tubular push-rod of the valve. The clip and the corresponding flange portion form the fulcrum of the lever. By virtue of its design, the lever pivots substantially about an axis orthogonal to the longitudinal axis defined by the tubular rod. This design has several disadvantages. Firstly, the zone in which the force is applied has a small angular range and it is necessary to apply one finger to the zone provided to this end, which is of modest dimensions. In addition, the possibility of extending the lever action is limited precisely by the design of the device, as the fulcrum of the lever is situated approximately on the flange of the closure seat of the device, while the other end preferably does not extend beyond the overall radial dimensions of the container for reasons of space and also so that it is possible to fit a cap covering the entire device and being fixed to the container. In a device of this kind, therefore, the force to be exerted must be applied over a zone of reduced angular dimensions and, in addition, the lever action is still limited precisely by the design of the device.

GB-A-1 359 152 describes a device in which the zone in which force is applied by the user has an angular range of 360°, giving the user a large bearing surface and leaving him free to select the point at which the actuating force is exerted. In this device, the push-button consists of a conical surface comprising on its axis a projection which presses on the valve stem, a cylindrical skirt being integral with the said conical surface and being provided with bearing means capable of cooperating, either at the exterior or in the interior, with a stop formed by the mounting flange of the valve seat. According to the position of the actuating force over the zone of application, a lever system is formed, the fulcrum of which is situated on the mounting flange, this fulcrum being situated substantially in a plane passing through the longitudinal axis and the point of application of the force. However, in this device, as in the device of FR-A-2 113 376, the possibility of extending the lever action is limited precisely by the design of the container and, consequently, the force to be applied necessarily remains considerable.

In order to reduce the force to be applied, it has been proposed to reduce the force of the valve spring. However, in this case, the long-term tightness of the valve becomes insufficient.

SUMMARY OF THE INVENTION

This invention relates to a device in which it is possible to reduce in a variable manner the force that has to be applied by the user to depress the valve stem without altering the force of the valve spring.

More precisely, this invention consists of an actuator device for a distribution valve provided on a container containing a product to be distributed, especially a pressurised aerosol, the valve comprising a tubular push-rod defining a longitudinal axis and having one end provided with a delivery orifice, the device comprising lever means for actuating the valve, these means comprising a push-button the outer face of which has a zone for the application of a force for actuating the valve, the push-button comprising, on the one hand, a projection coming to rest against the end of the rod and equipped with a delivery nozzle and a duct connecting the delivery orifice to the said nozzle and, on the other hand, bearing means capable of cooperating with complementary stop means connected to the container in order to form a fulcrum for the lever, in which the said zone of application has an angular range centred on the said longitudinal axis of at least approximately 180° and, the bearing means and the stop means have an angular range corresponding to that of the said zone in order to define together, as a function of the position of the actuating force over the zone of application, a fulcrum for the said lever, situated substantially in the plane passing through the longitudinal axis and the point of application of the force, characterised in that the stop means form part of a collar fixed to the container.

According to the invention, the fulcra of the lever on the collar are preferably situated closer to the valve than when the said fulcrum is situated on the mounting flange of the valve. Consequently, the force to be exerted in order to actuate the valve is smaller. The size of the diameter of the collar can be selected in a simple manner, so that it is possible to vary the value of the force to be exerted. This type of variation was impossible with the state-of-the-art devices. The collar can be fixed to any type of container, e.g. a container formed in one piece or a container consisting of three components. In addition, it should be noted that when the fulcrum of the lever is situated on the mounting flange of the valve seat, it is generally situated at a level lower than the height of the valve stem. Consequently, the pressure exerted by the lever is always at an angle relative to the axis of the valve stem and this pressure results in lateral displacement of the top of the valve stem when pressure is applied thereto by the lever. The valve can be damaged in this manner. The collar according to the invention can be dimensioned in a simple manner so that the fulcra of the lever are situated substantially in a plane perpendicular to the axis of the collar and passing through the end of the tubular rod.

For a container of the type having an upper opening closed by an upper valve seat, the seat being fixed to the opening of the container by a mounting flange, the said collar preferably presses via a lower edge against the container and comprises fixing means adapted to cooperate with a recessed portion of the container under the said flange. This arrangement is advantageous as, in this invention, the flange of the container serves only to fix the stop means and not the fulcrum of the lever.

By virtue of the large angular range of the zone of application of the actuating force, this push-button has the advantage of a large bearing surface, facilitating operation of the device.

In a preferred embodiment, the said angular range of the zone of application is between approximately 180° and 360°, in particular, approximately 270°. This large bearing surface improves the ergonomics, as it is possible to operate the push-button using several fingers, or only one finger if desired, without any special effort, as the finger naturally moves into the correct position.

The angular range of the bearing means and the stop means is preferably between approximately 180° and 360° so that it corresponds with the preferred values for the angular range of the zone of application.

The fulcra formed by the bearing means and the complementary stop means advantageously have as their geometric locus a narrow strip in the shape of the arc of a circle or a circle the angular opening of which is between approximately 180° and 360°, and the axis of which merges with the said longitudinal axis. This arrangement is preferred as the distance between any fulcrum and the end of the push-rod is substantially constant, so that the actuating force to be applied to the push-button is thus substantially constant when the point of application of this actuating force remains substantially at the same distance from the longitudinal axis. The lengths of the lever arms used therefore have virtually constant values. Under these conditions, the force to be exerted, e.g. by a finger, depends essentially on the distance between its zone of application and the longitudinal axis but will be unaffected by the angular position of the zone of application of the push-button.

In a preferred embodiment, the bearing means surrounding the said stop projection comprise a cylindrical sleeve, generated by rotation about the longitudinal axis, having, in the vicinity of its end open towards the container, a projecting radial shoulder forming overall a circular ring, the outer contour of which forms a bearing circle adapted to cooperate with the complementary stop means.

The complementary stop means situated on the collar preferably consist of a planar face substantially orthogonal to the longitudinal axis and fixed in position opposite the container, this face being defined by a circular opening coaxial with the longitudinal axis and having a radius greater than the outer radius of the sleeve, but smaller than the radius of the bearing circle. This arrangement has the advantage of retaining the push-button as the circular ring of the sleeve comes to rest against the planar face in a zone close to the circular opening. The above means together define, in a very simple manner, a single fulcrum when the plane of the ring is slightly inclined relative to the planar face while remaining in contact therewith.

The circular ring is advantageously divided into several segments by means of interstices in order to make them slightly deformable and to facilitate passage through the coaxial circular opening by the said ring during mounting.

In addition, the circular ring is preferably continued by a truncated lateral face converging towards the open end of the sleeve in order also to facilitate positioning and the passage through the coaxial circular opening by the ring.

In a preferred embodiment, the ring is in contact with the said face or is in the immediate vicinity thereof when the tubular rod of the valve is at rest. This arrangement means that an actuating force can be applied immediately to the valve, reducing the clearance of the mechanism.

In a preferred embodiment, the duct opens into a truncated recess of the projection, this recess resting against and covering the end of the rod in a coupling connection. This arrangement allows for inclination of the push-button relative to the longitudinal axis while still obtaining a sufficient connection between the end of the rod provided with a delivery orifice, the duct and the nozzle.

In a preferred embodiment, the delivery nozzle is formed substantially in the centre of the outer face of the push-button and in a substantially longitudinal direction. This arrangement means that the zone of application of the actuating force can have an angular range of 360°.

In another embodiment, the delivery nozzle is formed on the projection in a substantially radial direction.

The invention will be more readily understood from the following description of two embodiments, illustrated purely by way of non-limiting examples, and with reference to the accompanying drawings, in which:

DETAILED DESCRIPTION OF THE INVENTION

Figure 1:
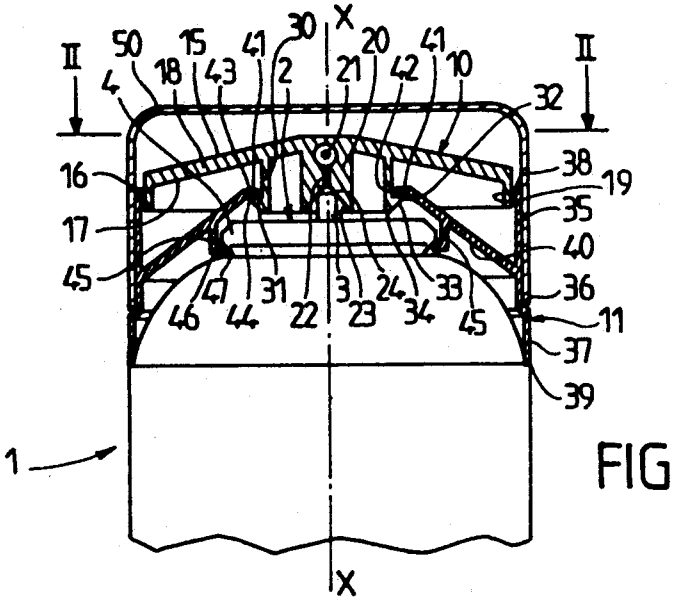
FIG. 1 is a longitudinal section of a first embodiment of this invention.

FIGS. 1 to 4 illustrate a first embodiment of this invention, clearly showing a container, known per se, designated in general by the reference numeral 1 and containing a pressurised aerosol. This container is of the type having an upper opening closed by the circular seat 2 of a distribution valve, the tubular push-rod 3 of which can be seen, defining a longitudinal axis X—X. The seat 2 is fixed to the opening of the container by a mounting flange 4. The device according to the invention comprises lever means for actuating the valve, these means comprising two distinct components. The first component consists of a push-button designated in general by the reference numeral 10. The second component comprises a collar for fixing to the container, designated in general by the reference numeral 11.

The push-button 10 is a component moulded in one piece, in particular of a thermoplastic material. The push-button 10 has an outer face 15 of generally truncated shape generated by rotation, forming a zone of application **15*a* extending over more than 180° about the axis X—X for an actuating force for the valve. This face 15 is bordered on its periphery by an edge face 16 forming a cylindrical segment generated by rotation about the axis X—X. The diameter of this cylindrical face 16 is smaller than that of the cylindrical container 1. The push-button 10 has an inner face 17 corresponding to the face 15 and parallel thereto. This inner face 17 of the push-button defines a concave space generally opposite the container. The two faces 15 and 17 together define a wall 18 of generally constant thickness. A parallel inner cylindrical face 19 also corresponds to the edge face 16**. These faces together define a cylindrical wall of substantially constant thickness.

The push-button 10 comprises a cylindrical projection 20 generated by rotation and having an axis X—X and formed in one piece with the wall 18. This projection 20 comprises in its upper part close to the wall 18 a nozzle 21, the axis of which extends in a substantially radial direction. This nozzle 21 is connected to a longitudinal duct 22 having an axis X—X which opens on to the lower end of the said projection. This end comprises a truncated recess 23 which rests against and covers the end 24 of the push-rod in a fluid coupling connection. The truncated shape of the recess 23 allows for a certain inclination of the projection 20 relative to the axis of the push-rod 3. This inclination nevertheless allows for a coupling connection between the end 24 of the rod and the nozzle 21. The projection preferably consists of an elastically deformable thermoplastic material in order to ensure good coupling contact between the end of the rod and the truncated recess of the projection.

A sleeve 30 of generally cylindrical shape projects into the concave portion defined by the inner face 17 of the push-button. This cylindrical sleeve 30 generated by rotation about the axis X—X surrounds at least part of the projection 20 and has, in the vicinity of its end open towards the container 1, a projecting radial shoulder 31 generally forming a circular ring, the outer contour of which forms a bearing circle 32 adapted to cooperate with the complementary stop means of the collar 11. The shoulder 31 is continued by a truncated lateral face 33 converging towards the open end 34 of the sleeve 30.

The collar 11 comprises a first outer upper cylindrical wall 35. This wall is continued by a radially projecting shoulder 36 which is extended by a second outer cylindrical wall 37. The collar 11 is defined by an upper cylindrical edge 38 and a lower circular edge 39. The circular edge 39 comes to rest against a rim of the container 1. The first wall 35 is integral with a wall 40 interior to the collar 11. This wall 40 has the general shape of a truncated cone converging towards the top. This inner wall 40 is defined in its upper part by a circular wall 41 comprising a circular opening 42 having an axis X—X. This circular opening 42 has a radius greater than the outer radius of the sleeve 30 but smaller than the radius of the bearing circle 32. This circular wall 41 is defined by an upper face 43 and a lower planar face 44 acting as a stop for the shoulder 31 and the bearing circle 32. This lower planar face 44 is substantially orthogonal to the axis X—X. The wall 40, which defines a concave space opposite the upper end of the container 1, is integral with a wall 45 in the form of a cylindrical collar which ends, towards the container, in a radial rim 46 defining a circular orifice 47. The radial rim 46 engages under the flange 4 in order to form the means for fixing the collar 11 to the container 1 in cooperation with the circular edge 39 of the collar 11.

The face of the edge 16 of the push-button engages in the space defined by the upper end of the wall 35 of the collar 11. In this embodiment, in which the container is of the type having an upper opening closed by a circular valve seat 2, the radius of the bearing circle 32 is smaller than the radius of the circular seat 4. A movable cover 50 in the form of a cylindrical cap can cover the device by sliding over the outer cylindrical face of the wall 35 of the collar 11.

Figure 2:
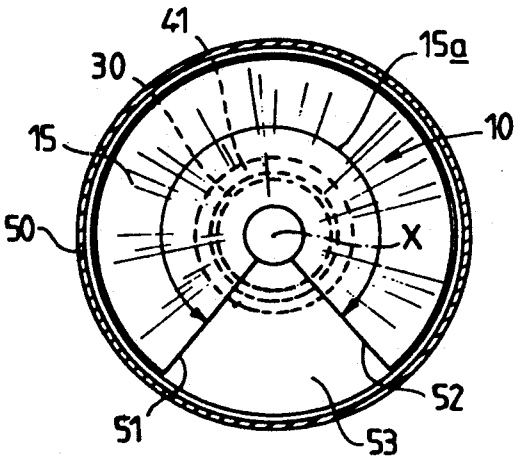
FIG. 2 is a transverse section along the line II—II of FIG. 1.

As can be seen more clearly in FIG. 2, the wall 18 of the push-button 10 and a portion of the sleeve 30 are interrupted by two radial edges which define an angular sector greater than or equal to the angular sector of the jet emerging upon operation of the nozzle 21. The radial edges of the wall 18 are continued towards the bottom by two planar walls 51 and 52 which join the projection 20 and which end in a wall 53 consisting of a circular sector substantially orthogonal to the axis X—X and formed in one piece with the projection 20 in a zone close to the lower end thereof. The lower end of the sleeve 30 of generally circular shape is continued in one piece by the wall 53 under the lower face of the latter. In a manner which is not shown in FIGS. 1 to 4, but which can be seen in FIG. 6, the sleeve 30 and the circular ring 31 are divided into several segments by means of interstices. The walls 51, 52 and 53 create a recessed zone in front of the nozzle for the passage of the ejector cone.

The device is mounted on the container 1 as follows. The collar 11 is positioned on the end of the container 1 by snap engagement of the radial rim 46 and the flange 4 in the recessed part of the container under the said flange. The push-button 10 is then fixed in the circular opening 42 of the ring, so that said opening 42 is traversed by the shoulder 31 of the sleeve 30. This passage is facilitated by the presence of interstices on the sleeve and the shoulder 31.

Figure 3:
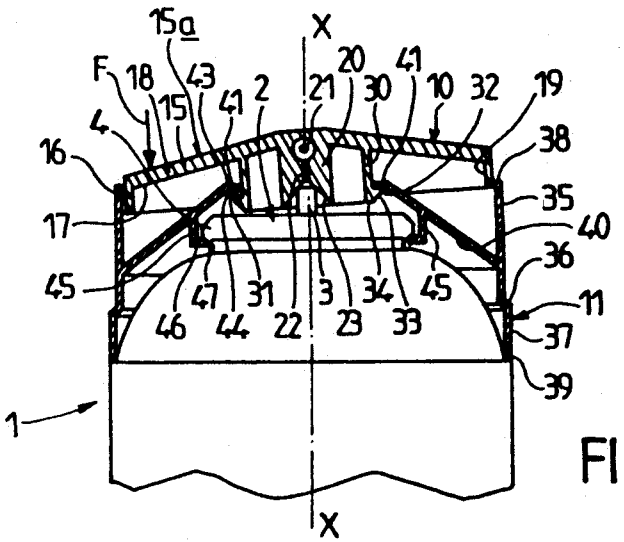
FIG. 3 like FIG. 1, shows the device when the push-button is pressed slightly from one side.
Figure 4:
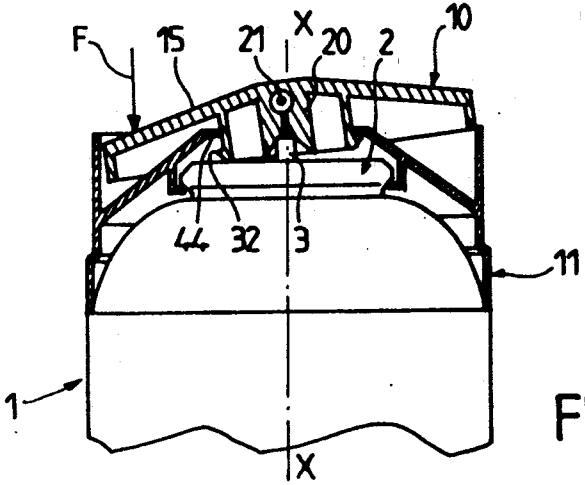
FIG. 4 like FIG. 3, shows the device with the push-button pressed to a greater extent from the same side.

FIGS. 3 and 4 show the operation of the device according to this invention. An actuating force (F) is applied to the left hand portion of the zone of application 15*a* of the push-button. The push-button 10 is inclined and, on the left hand side, penetrates slightly into the interior of the collar 11. The bearing circle 32 then comes to rest on the other hand towards the right against the stop formed by the planar stop face 44 of the collar 11. At the same time, the projection 20 presses on the end of the push-rod 3 and presses it into the valve to begin the release of the product contained in the container 1. FIG. 3 shows the push-button rotated to a greater extent relative to the push-rod 3, so that said push-rod is pressed further into the valve and the valve is opened more completely.

Figure 5:
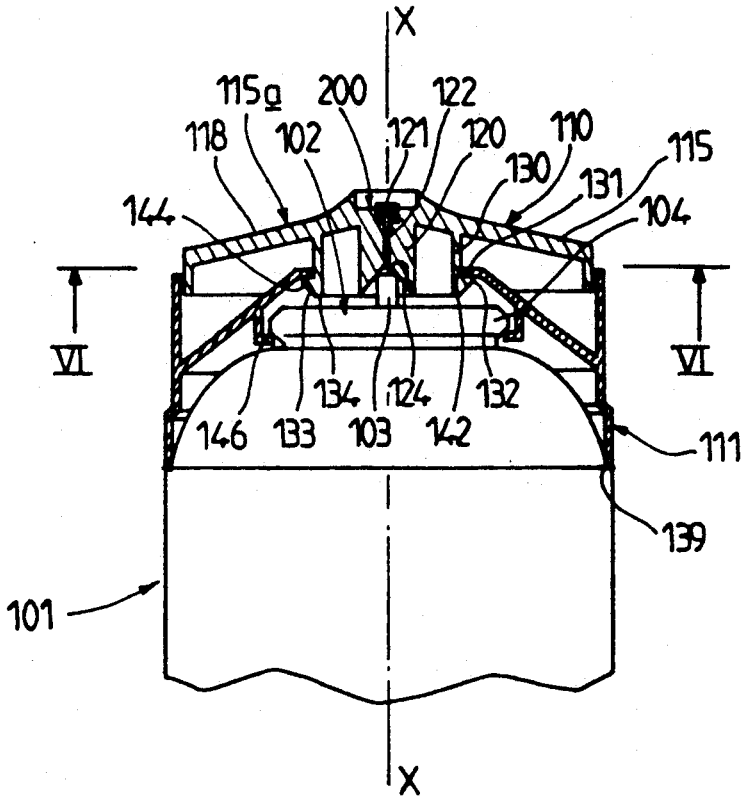
FIG. 5 shows a second embodiment of this invention.
Figure 6:
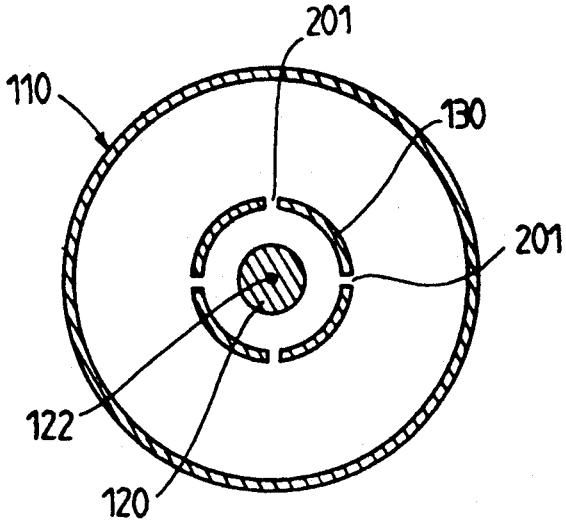
FIG. 6 is a section along the line VI—VI of FIG. 5.

FIGS. 5 and 6 show a second embodiment of the device according to the invention. The components corresponding to those of the preceding embodiment have been given reference numerals increased by 100. In this embodiment, the essential difference is the fact that the delivery nozzle 121 is formed substantially in the centre of the outer face 115 of the push-button 110 in the extension of the duct 122 and along the axis X—X. The central portion of the wall 118 of the push-button comprises a thickened portion, helping to form a cylindrical recess 200 on to which the nozzle 121 opens. This cylindrical recess forms a small reservoir for the small quantities of the substance to be distributed that may remain in contact with and in the vicinity of the delivery nozzle 121 following actuation of this valve, thereby preventing any contamination of the bearing zones by this product. In this embodiment, the angular range of the zone of application 115*a* is 360°.

FIG. 6 shows that, in this embodiment, the sleeve 130 and the shoulder 131, forming a circular ring, have been divided into four segments by four interstices 201. The mounting and operation of this device are completely analogous to those described hereinbefore. If the container 101 is an aerosol can, the nozzle sprays a jet of a conical shape, the axis of which then corresponds to the longitudinal axis X—X.

I claim:

1. Actuator device for a dispensing valve of a container of the type having a product to be dispensed maintained under pressure with a pressurized fluid, said container having a collar mounted thereon surrounding said valve with said valve comprising a push-rod having a longitudinal axis and an end having a delivery orifice, said actuator device comprising lever means for actuating the valve, said lever means including a push button having a zone for the application of force by a user, said push button including a projection engaging the end of the push-rod, said projection having a delivery nozzle and a duct communicating with said nozzle and the delivery orifice of the push-rod, said lever means having bearing means and said actuator device including stop means disposed on the collar, said bearing means cooperating with said stop means to define a fulcrum for said lever means, said zone of said push button having an angular region extending about the longitudinal axis of the push-rod to at least 180°, said bearing means and said stop means extending about the longitudinal axis of the push-rod to substantially the same extent as said zone of said push button, so that said fulcrum lies substantially in a plane extending through the longitudinal axis of the push-rod, said stop means forming a portion of said collar, said bearing means comprising a substantially cylindrical sleeve concentrically disposed relative to the longitudinal axis of said push-rod, said sleeve having an open end, remote from said zone of said push button, provided with a radial shoulder projecting outwardly of said sleeve to define a bearing circle for cooperation with said stop means, said bearing circle having a selected radius, said container having a circular seat surrounding said push-rod, said bearing circle having a radius smaller than said radius of said seat, said zone of said push button being located spaced outwardly along said longitudinal axis relative to said bearing circle, wherein said collar has an uppermost portion and said uppermost portion lies in a given plane and said fulcrum of said lever means on said stop means is located substantially in said given plane of said uppermost portion of said collar with said collar having an axis and said given plane extending perpendicular to said axis of said collar and through the said end of said push-rod.

2. The device as claimed in claim 1 wherein said container has an open end closed by said circular seat, said seat being fixed on said container, said collar having a lower edge engaging said circular seat to retain said collar on said container.

3. Device according to claim 1 or 2, characterised in that the angular extent of the bearing means (32, 132) and the stop means (44, 144) is between approximately 180° and 360°.

4. The device as claimed in claim 3 wherein said fulcrum is defined by a locus of points lying on a circular arc having an angular extent of between 180° and 360° and a central axis coincident with said longitudinal axis of said push-rod.

5. The device as claimed in claim 1, wherein said stop means is provided with a stop face which extends substantially orthogonal to said longitudinal axis of said push rod, said stop face being defined by a circular surface having on axis disposed coaxially with respect to the longitudinal axis of said push rod, said circular surface having a radius greater than the outer radius of said sleeve but smaller than the radius of said bearing circle.

6. The device as claimed in claim 5, wherein said cylindrical sleeve together with said stop face are circumferentially discontinuous with gaps being located at spaced points about the periphery of said sleeve.

7. The device as claimed in claim 5, wherein said stop face has an outer peripheral edge connected to said lower end of said sleeve by means of a convergently sloped wall.

8. The device as claimed in claim 7, wherein said bearing means is in contact with said stop face when said push rod is in a deactuated, rest position.

9. The device as claimed in claim 1, wherein said projection has an end remote from said nozzle, said remote end being provided with a truncated recess in which is received the end of said push rod in a fluid coupling connection.

* * * * *